United States Patent [19]

Degen

[11] Patent Number: 4,783,863

[45] Date of Patent: Nov. 15, 1988

[54] BEDDING FURNITURE WITH A PENDULUM FRAME

[75] Inventor: Hugo Degen, Seltisberg, Switzerland

[73] Assignee: Marpal AG, Chur, Switzerland

[21] Appl. No.: 898,718

[22] Filed: Aug. 21, 1986

[30] Foreign Application Priority Data

Sep. 3, 1985 [CH] Switzerland ..... 3789/85

[51] Int. Cl.[4] ..... A47D 9/00; A47C 23/08

[52] U.S. Cl. ..... 5/103; 5/106; 5/124; 5/244

[58] Field of Search ..... 5/200 R, 207, 208, 209, 5/210, 204, 244, 412, 108, 109, 105, 106, 107, 104, 127, 128, 129, 130, 120, 121, 122, 123, 124, 125, 126, 101, 102, 103, 104, 118

[56] References Cited

U.S. PATENT DOCUMENTS

| | | | |
|---|---|---|---|
| 478,450 | 7/1892 | Meek | 5/129 X |
| 729,950 | 6/1903 | Lindsey | 5/244 |
| 888,045 | 5/1908 | Shaw | 5/104 |
| 889,065 | 5/1908 | Temples | 5/101 |
| 1,406,737 | 2/1922 | Hoy | 5/210 X |
| 1,732,008 | 10/1929 | Frantz | 5/129 X |
| 2,377,464 | 6/1945 | Tucker | 5/244 |
| 2,814,052 | 11/1957 | Kaiser | 5/210 |
| 3,125,767 | 3/1964 | Griggs et al. | 5/109 |
| 4,419,778 | 12/1983 | Griffith | 5/244 |
| 4,567,614 | 2/1986 | Haider et al. | 5/124 |

FOREIGN PATENT DOCUMENTS

| | | | |
|---|---|---|---|
| 8634 | of 1904 | France | 5/129 |
| 1451981 | 10/1976 | United Kingdom | 5/108 |

*Primary Examiner*—Michael F. Trettel

*Attorney, Agent, or Firm*—Ralph W. Selitto, Jr

[57] ABSTRACT

A pendulum frame (2) is suspended on a fixed stand (1) by means of four pendulums (16). The amplitude of each of the pendulums (16, 17) is limited by a plate (24) provided with an orifice (23). The plates (24) carry locking projections (28), into which detent pawls (26), arranged on the pendulum frame (2) can engage. When only one of these detent pawls (26) is in the locking position, the bedding furniture can swing about this detent pawl which functions as a pivot pin. When two detent pawls (26) located behind one another in the longitudinal direction of the bedding furniture are locked, the pendulum frame (2) is blocked and is held outside its mid-position on one side. A free-swinging mid-position, four pendulum positions locked at one point and two fixing positions locked off-center are therefore available for each piece of bedding furniture.

The bedding furniture can be adapted to meet individual sleeping requirements and is also characterized in that bed care becomes considerably easier.

18 Claims, 5 Drawing Sheets

Figure 1:
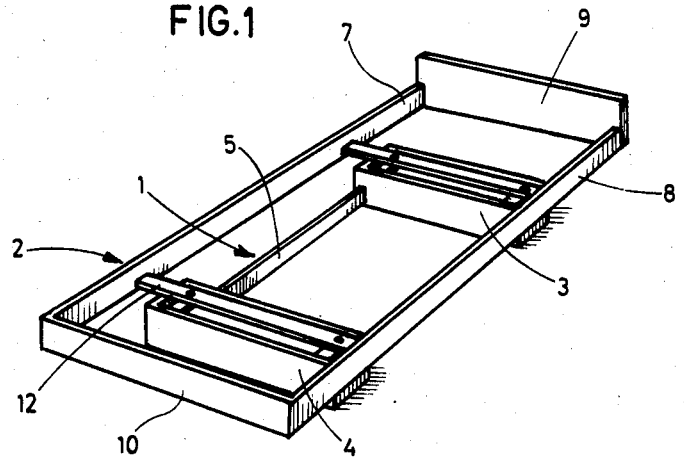

FIG.3
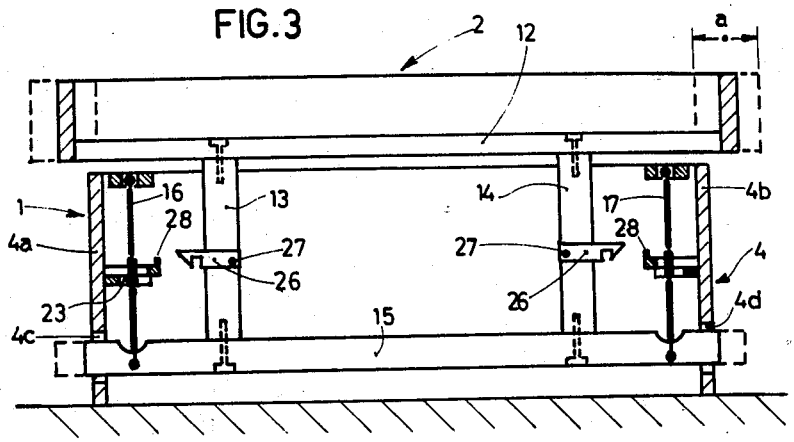
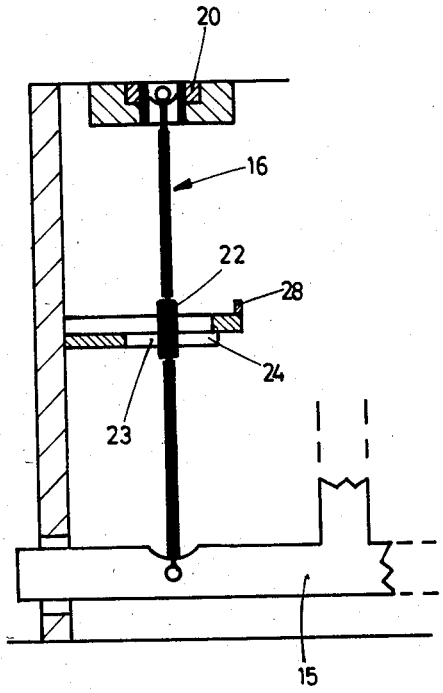
FIG.4
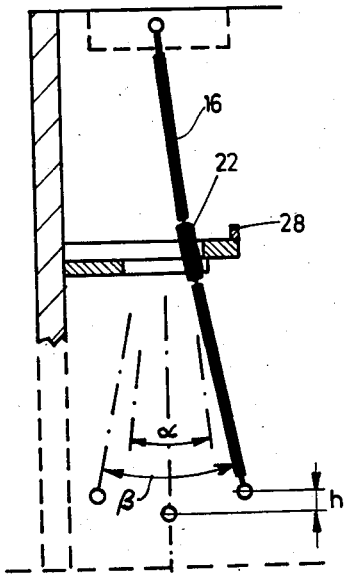
FIG.5

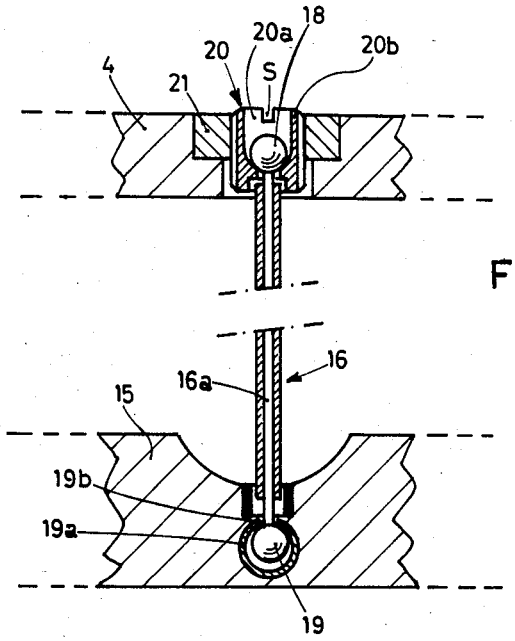
FIG. 8
FIG. 9
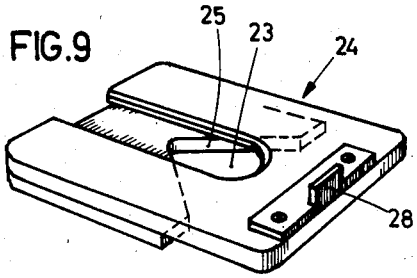
FIG. 10
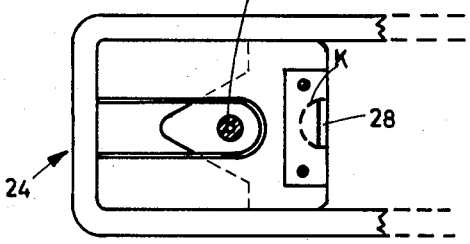
FIG. 11
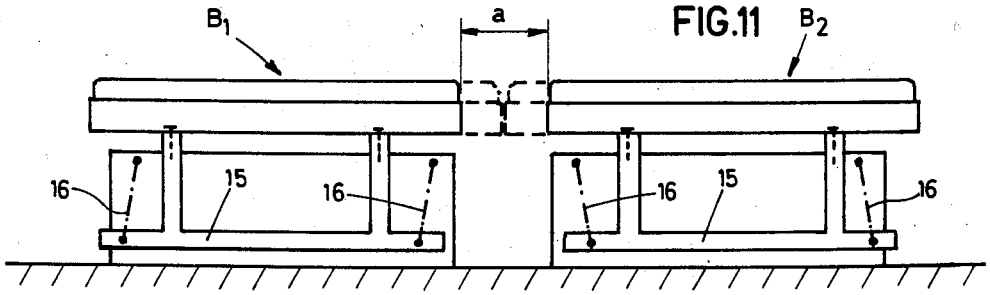

FIG.12
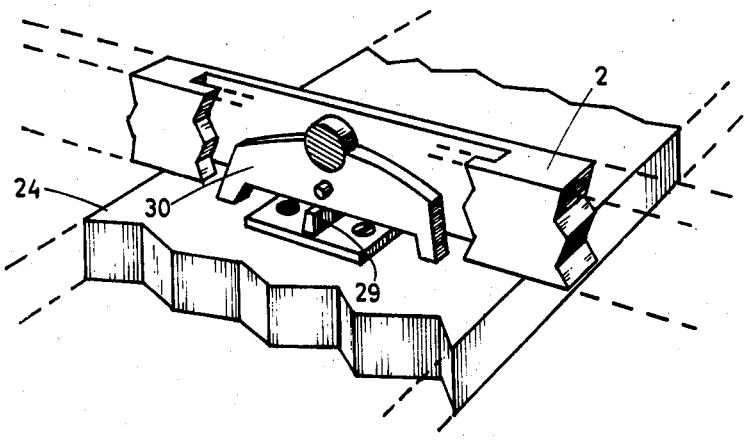
FIG. 13
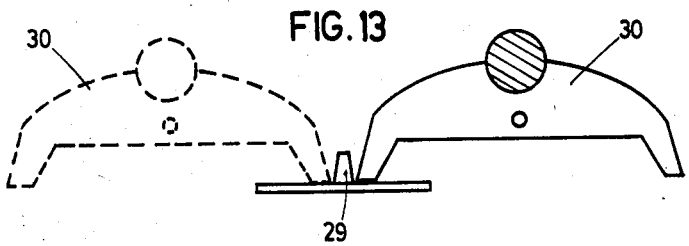
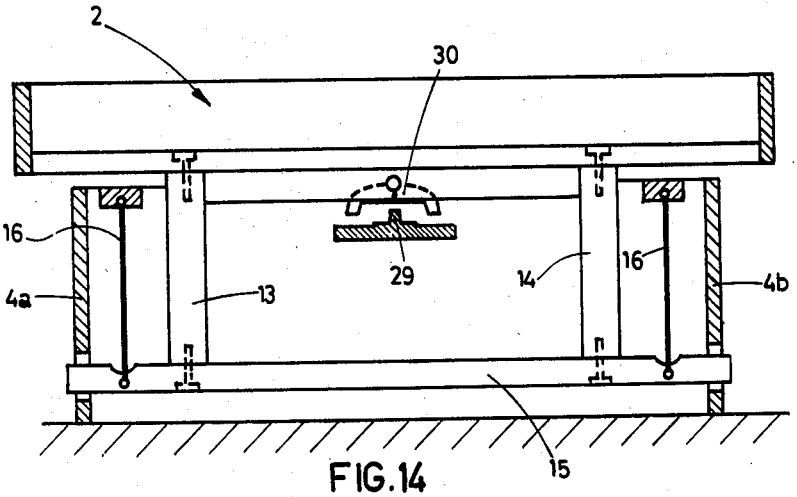
FIG.14

BEDDING FURNITURE WITH A PENDULUM FRAME

Everyone is well aware from breathing and the beating of the heart that our life, indeed "living" in general, has a rhythm, that is to say periodically recurring vibrations. In particular, a person's equanimity and emotional life can be influenced greatly by rhythm, as is known, for example, from pendulum hypnosis. The relationship between such rhythmic movement and sleep has also been known for a long time: indeed, mothers have been rocking their children to sleep for thousands of years, either in a cradle or in their arms; and every railroad passenger is aware of the soporific effect of the rhythmic traveling noises and movements which unfailingly occur during a relatively long railroad journey.

If we reflect that many of our contemporaries suffer from sleeplessness, and that, in particular, the number of people sleeping badly has constantly increased in recent decades, it is astonishing that we have hitherto concentrated mainly on the development of pharmaceuticals and that a natural sleeping method, which proves so effective for small children, has not already long been used for the sleep behavior of adults.

Although the pendulum suspension of beds to promote sleeping or to eliminate disturbed sleep has been known for a long time in principle, especially when used on children's beds (see, for example, U.S. Pat. Nos. 238,843 and 888,045), nevertheless only in the last few years have the experts considered it seriously for use with adults. Thus, for example, German Offenlegungsschrift No. 3,229,934 published in February 1984 describes sitting or resting furniture which is suspended on a stand via several pendulums so as to swing freely. The furniture, for example a bed, can be stopped by means of a mechanism connecting the fixed stand to the part with the pendulum suspension, so that it only has the effect of a static bed. At the same time, the amplitude of the pendulum movement can be limited by a counter-pendulum arranged,, centrally.

German Utility Model No. 8,435,922 published in March 1985 likewise describes a resting surface which has a pendulum suspension and which is suspended at a point located on the fixed structure, in such a way that it can be rotated by more than 360°. Here again, connecting elements can be provided to limit the swing of the resting surface.

Although these known constructions of resting surfaces with a pendulum suspension can impart a swinging movement to the resting person, nevertheless this bedding furniture cannot meet the sleeping requirements of particular individuals, and moreover they also prove disadvantageous from the point of view of daily bed care. In particular, if it is remembered that a bed with a pendulum suspension, which is designed, for example, according to German Offenlegungsschrift No. 3,229,934, has to be arranged at a minimum distance from the wall or from the adjacent bed because of its lateral freedom of swing, and that during bed-making such beds have to be repeatedly pulled away from the wall or the adjacent bed and pushed back again, the bed-care factor which is decisive for the housewife or for the bed personnel assumes considerable importance. According to Swiss Patent Specification No. 646,042, this problem is intended to be solved on stationary beds by arranging three wheels on the bed frame that the bed can be pivoted about a vertical axis, thus allowing free axis for bed care.

The object of the present invention is to provide bedding furniture with a pendulum suspension, which allows the controled adjustment of the pendulum movement to meet individual sleep requirements and which, at the same time, makes bed care easier.

The invention is defined in the independent patent claim 1, and preferred exemplary embodiments emerge from the dependent patent claims.

Figure 2:
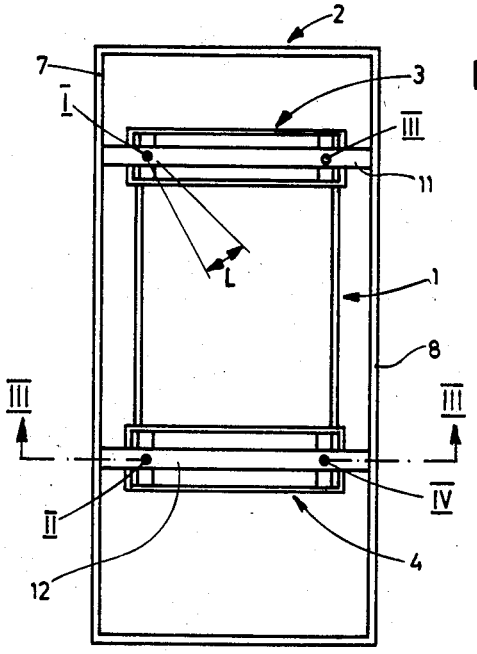
Figure 6:
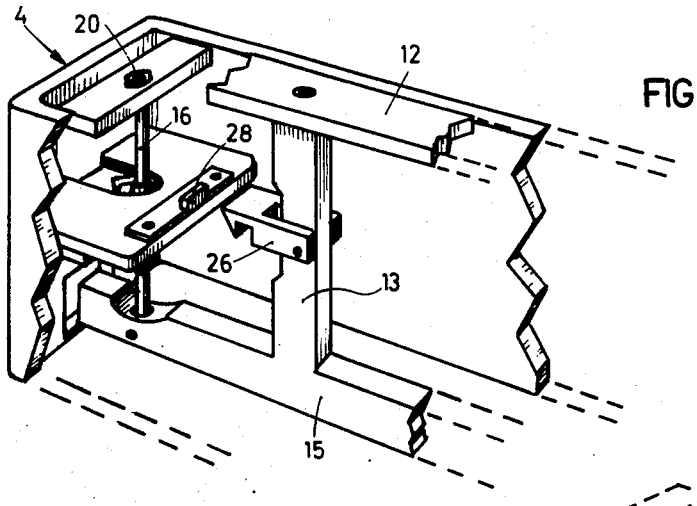
Figure 7:
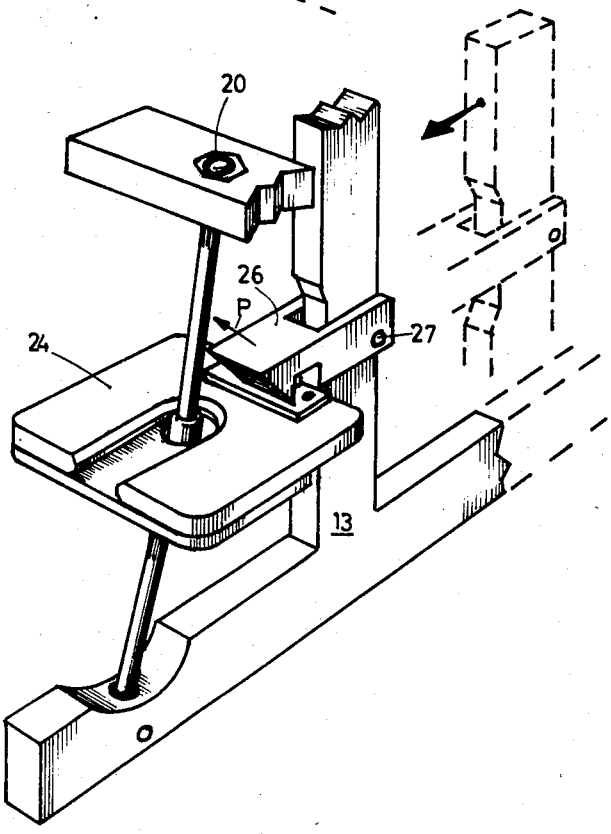

An exemplary embodiment of the subject of the invention, together with some alternative constructional forms, is described with reference to the attached drawing. In the drawing:

FIG. 1 shows a simplified perspective view of a bed equipped with a pendulum frame, FIG. 2 shows a corresponding plan view, FIG. 3 shows a section along the line III—III in FIG. 2, FIGS. 4 and 5 show detailed views of the pendulum suspension, FIG. 6 shows a part perspective view of the partially cut away bed stand, FIG. 7 shows a perspective view of the pendulum suspension in one end position, FIG. 8 shows a section through a further detail of the suspension, FIG. 9 shows a perspective representation of a constructive detail of the amplitude-limiting device, FIG. 10 shows a corresponding plan view, FIG. 11 shows a simplified front view of two beds arranged next to one another, FIG. 12 shows a perspective view of an alternative form of the locking system in the mid-position, FIG. 13 shows a simplified representation of the two locking positions, and FIG. 14 shows a vertical section through the bed stand.

The bedding furniture illustrated in FIG. 1, of which the resting surface provided, for example, with cross-laths has been omitted for the sake of clarity, has a fixed stand 1 and a pendulum frame 2 suspended on the latter. In the embodiment illustrated, the stand 1 comprises two feet 3 and 4 which are arranged at a distance from one another and which are supported on the floor and are connected by means of connecting rods 5 and 6 to form a rigid unit.

The pendulum frame 2 has two longitudinal casing members 7 and 8, two end faces 9 and 10, two crosspieces 11 and 12 and the suspension device yet to be described, which engages on the crosspieces.

The sectional representation according to FIG. 3 shows the constructive design of the foot 4 which corresponds to that of the foot 3. The description of the suspension members on the foot 4 therefore also applies accordingly to the foot 3. The crosspiece 12, which together with the crosspiece 11 carries the pendulum frame 2, is supported, via two vertical legs 13 and 14, on a rocker beam 15 which has a pendulum suspension and the two ends of which project through orifices **4*c*, 4*d* in the sidewalls 4*a*, 4*b* of the box-shaped foot 4. The rocker beam 15 hangs on two flexible pendulums 16 and 17 which, in a way yet to be described, are articulated so as to be freely movable on the rocker beam 15 at their bottom ends and on the fixed foot 4 at their top ends. The pendulum frame 2 can thus swing in a plane 3** parallel to the resting surface within the limits predetermined by the suspension.

FIG. 8 shows a possible constructive design of the pendulums. According to this, the pendulum 16 has a ball 18, 19 at each of its two ends, both of these balls being mounted in such a way that they allow noise-free and low-friction movement of the pendulum 16 and simple adjustment of the length of the latter. For this purpose, the lower ball 19 is pushed into a sleeve 19*a* open on one side, through the upper slot 19*b* of which projects the pendulum 16 which itself consists of a steel string 16*a* and a rubber sleeve 16*b* surrounding this. The upper ball 18 sits in the cavity 20*a* of a hollow screw 20 which by means of its external thread 20*b* can be screwed into a threaded bore in a nut 21 embedded in the box 4. The hollow screw 20 has a lateral orifice for the insertion of the ball 18 and, for height adjustment, can be actuated at an upper slot S by means of a screwdriver.

Arranged approximately in the center region of the pendulum 16 is an elastic buffer 22 (FIGS. 4 and 10) which projects through the orifice 23 in a plate 24 fastened to the foot 4 (FIG. 9). The movement of the buffer 22 is limited on all sides by the plate 24, and the orifice 23 has an acute-angled centering point 25 on its side facing away from the longitudinal axis of the bedding furniture.

According to FIG. 3, arranged on each leg 13, 14 is a detent pawl 26 which is pivotable about an axis 27 (see also FIG. 7). In one of its end positions, the detent pawl 26 swinging with the pendulum frame engages into a projection 28 located on the plate 24, with the result that the pendulum frame 2 is immobilized at this point.

For reasons to be explained later, the projection 28 is preferably designed with a curved contact face K (FIG. 10), in order to limit the friction between the projection 28 and the detent pawl 26 to a minimum.

The device described works as follows: when the pendulum frame 2 is in its mid-position corresponding to the illustrations according to FIGS. 3, 4 or 6, it starts to swing under the influence of even very small pulses (heart beats, breathing or changes in the position of the resting person) and is also kept swinging by these. Of course, such swinging pulses starting the pendulum movement can also be triggered deliberately by pushing away from the adjacent wall, etc.

However, as soon as the amplitude of the pendulum 16 becomes so great that the buffer 22 comes up against the boundary of the orifice 23 (FIG. 5), the amplitude is limited and consequently the pendulum action is moderated (see the angles $\alpha$ and $\beta$ in FIG. 5).

Although this free pendulum movement, uncontroled as regards the swinging direction, would seem to be sufficient in many cases, experiments have nevertheless shown that for most people a controled pendulum movement produces much more favorable results. Such a controled influence on the pendulum movement is made possible by the four detent pawls 26, in interaction with the corresponding projections 28, which are arranged at the four locations on the bedding furniture designated in FIG. 2 by I, II, III and IV.

If, for example, the pendulum frame 2 is locked at location I, this location can be considered as a fixed point during the pendulum movement of the pendulum frame 2, so that the pendulum frame swings about this point I, for example according to the line L indicated in FIG. 2. If, for instance, the sleeper's head is in the region of location I, it is at rest, whereas the feet experience the maximum pendulum amplitude. Thus, by means of the device illustrated, five different individually adjustable pendulum actions are obtained, depending on which of the points I to IV is locked or whether all the points I to IV are free. Because of the curved shape of the contact face K (FIG. 10), the friction during the pendulum action is kept very low.

In a further alternative form (not shown), it would also be possible, for example, to suspend the pendulum frame on three pendulums only, and for instance two pendulums would have to be arranged at locations I and III and the third pendulum in the center between locations III and IV.

In contrast to this, if the detent pawls 26 are brought into the locking position at two locations arranged behind one another in the longitudinal direction of the bed, that is to say at I and II or at III and IV, the pendulum frame is blocked, so that any swinging is prevented. Locking can be effected very simply if the person, for example by leaning against a wall in the recumbent position, shifts the pendulum frame 2 to one side, until the two detent pawls 26 engage. To release them, it is sufficient to shift it a short way in the direction of the longitudinal axis of the bedding furniture (the arrow P in FIG. 7), whereupon the pendulum frame swings back into the mid-position again.

The locking method described has a particularly advantageous effect in simplifying daily bed care. According to FIG. 11, two beds $B_1$ and $B_2$ are at a distance a from one another when, on each bed, the two outer detent pawls 26, that is to say those facing away from the adjacent bed, are engaged. In this position which is preferably predominant throughout the day, the space a between the two beds is therefore free for bed care. In a corresponding way, it would be possible to make the space a/2 free between a bed and the adjacent wall by means of locking.

In the opposite locking position, in which the four detent pawls 26 facing one another are locked, the two beds butt against one another. This position is indicated by broken lines in FIG. 11.

As shown in FIG. 5, when the lower half of the pendulum 16 is deflected the pendulum frame 2 is raised by an amount a, with the result that it becomes easier to engage the detent pawl 26 fastened to the pendulum frame. Since the pendulum frame, after being locked on one side, is urged into its mid-position again, the detent pawl 26 is held securely against the locking projection 28.

The locking method described and illustrated in the drawing can be modified in many ways by a person skilled in the art within the scope of the inventive idea. Thus, according to FIG. 12, it is possible, for example, to attach a central projection 29 to the fixed plate 24, whilst a pivotably suspended rocker 30 would be arranged on the pendulum frame 2. Here again, as the result of an appropriate shift of the pendulum frame 2 it would be possible to obtain two locking positions which are shown in FIG. 13, whilst FIG. 12 illustrates the unlocked pendulum position.

I claim:

1. Bedding furniture, comprising a fixed stand, a pendulum frame, suspending means for suspending said pendulum frame from said fixed stand such that said pendulum frame can be swung horizontally in pendulum-like fashion from a rest position, and locking means for releasably locking said pendulum frame relative to said fixed stand at a stationary point located such that said pendulum frame can pivot about said point during its continued swinging movement, said locking means including at least one pair of locking members, said at least one pair of locking members including a first locking member mounted on said fixed stand and a second locking member mounted on said pendulum frame in such a manner that said second locking member will be releaseably and automatically engaged with said first locking member in response to a maximum swinging movement of said pendulum frame away from its said rest position, whereby said locking means permits the controlled adjustment of the swinging movement of said pendulum frame in the course of such movement.

2. Bedding furniture according to claim 1, wherein said first locking member is a projection and said second locking member is a centrally suspended rocker which interacts with said projection such that said projection moves relative to said rocker between two opposed ends of said rocker during the swinging movement of said pendulum frame and such that said ends of said rocker can be selectively engaged with said projection to releasably lock said pendulum frame to said fixed stand.

3. Bedding furniture according to claim 1, wherein said pendulum frame swings transversely with respect to said fixed stand, said pendulum frame also being moveable longitudinally with respect to said fixed stand.

4. Bedding furniture according to claim 3, wherein said second locking member of said at least one pair of locking members is disengaged with said first locking member of said pair of locking members in response to the longitudinal movement of said pendulum frame relative to said fixed stand.

5. Bedding furniture according to claim 1, further comprising limiting means for limiting the distance that said pendulum frame can be swung away from its said rest position.

6. Bedding furniture according to claim 1, wherein said locking means includes at least three pairs of locking members, whereby said pendulum frame can be locked at any one of three stationary points, at least two of said points being spaced apart longitudinally with respect to said fixed stand.

7. Bedding furniture according to claim 6, wherein there are four pairs of locking members, whereby said pendulum frame can be locked at any one of four stationary points, a first pair of said points being arranged on one side of a central longitudinal axis of said fixed stand and a second pair of said points being arranged on an opposite side of said central longitudinal axis of said fixed stand in such a manner that said first and second pairs of points are symmetrical with respect to each other about said central longitudinal axis of said fixed stand, all of said points being spaced the same distance from said central longitudinally axis of said fixed stand, whereby said points can be connected by imaginary lines to form an imaginary rectangle.

8. Bedding furniture according to claim 7, wherein said locking means can lock said pendulum frame relative to said fixed stand at one point of said first pair of points while also being locked relative to said fixed stand at the other point of said first pair of points, whereby said pendulum frame can be locked in a position in combination with an object arranged on said opposite side of said central longitudinal axis of said fixed stand, and wherein said pendulum frame can be locked relative to said fixed stand at one point of said second pair of points while also being locked relative to said fixed stand at the other point of said second pair of points, whereby said pendulum frame can be locked in a position proximate to said object.

9. Bedding furniture according to claim 8, wherein said object is another similar piece of bedding furniture.

10. Bedding furniture according to claim 7, further comprising limiting means for limiting the distance that said pendulum frame can be swung away from its said rest position.

11. Bedding furniture according to claim 10, wherein said suspending means including four pendulums, each pendulum being arranged in the vicinity of a corresponding one of said points.

12. Bedding furniture according to claim 11 wherein each of said pendulums includes a flexible tension member attached at one end to said fixed stand and at an opposite end to said pendulum frame.

13. Bedding furniture according to claim 12, wherein said limiting means includes four restraining members mounted on said fixed stand, each restraining member being arranged in the vicinity of a corresponding one of said pendulums so as to be engageable by an intermediate portion of said corresponding one of said pendulums during the swinging movement of said pendulum frame.

14. Bedding furniture according to claim 13, wherein said intermediate portion of each of said pendulums includes a noise-damping buffer to thereby reduce the noise produced when said pendulums engage said restraining members.

15. Bedding furniture according to claim 14, wherein each of said first locking members is mounted on a corresponding one of said restraining members.

16. Bedding furniture according to claim 15, wherein each of said first locking members is a projection and each of said second locking members is a detent pawl.

17. Bedding furniture according to claim 7, wherein said pendulum frame swings transversely with respect to said fixed stand, said pendulum frame also being moveable longitudinally with respect to said fixed stand.

18. Bedding furniture according to claim 17, wherein said second locking member of each pair of locking members is disengaged with said first locking member of its corresponding pair of locking members in response to the longitudinal movement of said pendulum frame relative to said fixed stand.

* * * * *